US011629525B1

(12) United States Patent
Tobias et al.

(10) Patent No.: US 11,629,525 B1
(45) Date of Patent: Apr. 18, 2023

(54) LOCK SYSTEM WITH MULTIFACTOR AUTHENTICATION

(71) Applicants: Marc Tobias, Pittsburgh, PA (US); Tobias Bluzmanis, Miramar, FL (US)

(72) Inventors: Marc Tobias, Pittsburgh, PA (US); Tobias Bluzmanis, Miramar, FL (US)

( * ) Notice: Subject to any disclaimer, the term of this patent is extended or adjusted under 35 U.S.C. 154(b) by 0 days.

(21) Appl. No.: 17/864,121

(22) Filed: Jul. 13, 2022

Related U.S. Application Data

(60) Provisional application No. 63/203,551, filed on Jul. 27, 2021.

(51) Int. Cl.

| | |
|---|---|
| ***E05B 19/24*** | (2006.01) |
| ***E05B 35/14*** | (2006.01) |
| ***E05B 27/00*** | (2006.01) |
| ***E05B 17/10*** | (2006.01) |
| *E05B 17/20* | (2006.01) |
| *E05B 19/00* | (2006.01) |
| *E05B 47/00* | (2006.01) |

(52) U.S. Cl.
CPC ..... *E05B 19/24* (2013.01); *E05B 17/103* (2013.01); *E05B 27/0057* (2013.01); *E05B 35/14* (2013.01); *E05B 17/2084* (2013.01); *E05B 19/0011* (2013.01); *E05B 2047/0084* (2013.01)

(58) Field of Classification Search
CPC ..... E05B 17/10; E05B 17/103; E05B 17/106; E05B 19/0011; E05B 19/0052; E05B 19/24; E05B 27/0003; E05B 27/0007; E05B 27/0057; E05B 35/14; E05B 17/2084; E05B 2047/0084; E05B 2047/0086
See application file for complete search history.

(56) References Cited

U.S. PATENT DOCUMENTS

| | | | | |
|---|---|---|---|---|
| 3,789,638 | A | | 2/1974 | Roberts |
| 4,109,495 | A | | 8/1978 | Roberts |
| 4,283,859 | A | | 8/1981 | Roland |
| 4,416,127 | A | * | 11/1983 | Gomez-Olea Naveda ..... G07C 9/0073 70/276 |
| 4,432,142 | A | | 2/1984 | Korsak |
| 4,433,487 | A | | 2/1984 | Roland |
| 4,507,944 | A | * | 4/1985 | Widen ..... G07C 9/00722 70/276 |
| 4,748,834 | A | * | 6/1988 | Herriott ..... E05B 47/0038 70/413 |
| 4,858,453 | A | * | 8/1989 | Namazue ..... B60R 25/04 250/221 |

(Continued)

*Primary Examiner* — Christopher J Boswell
(74) *Attorney, Agent, or Firm* — Jeffrey A. Proehl; Woods, Fuller, Shultz & Smith, PC

(57) ABSTRACT

A security system with multifactor authentication, and may comprise a lock assembly configured to secure an object and having a secured condition and an unsecured condition, a lock actuating element for actuating the lock assembly between the secured and unsecured conditions, a first authentication structure configured to permit actuation of the lock assembly by the lock actuating element when authenticated by the first authenticating structure, and a second authentication structure configured to permit actuation of the lock assembly by the lock actuating element when authenticated by the second authentication structure, so that authentication by the first authentication structure and the second authentication structure is required to actuate the lock assembly.

18 Claims, 3 Drawing Sheets

(56) References Cited

U.S. PATENT DOCUMENTS

| | | | | |
|---|---|---|---|---|
| 5,003,801 | A * | 4/1991 | Stinar | G07C 9/00182 70/408 |
| 5,561,997 | A | 10/1996 | Milman | |
| 6,442,986 | B1 * | 9/2002 | Russell | E05B 47/0634 70/283.1 |
| 7,849,721 | B2 * | 12/2010 | Bass | E05B 19/00 70/456 R |
| 10,400,475 | B2 * | 9/2019 | Klammer | E05B 19/0011 |
| 11,131,121 | B2 * | 9/2021 | Khlopkov | E05B 19/24 |
| 11,193,306 | B2 * | 12/2021 | Plunder | E05B 19/0052 |
| 2020/0300002 | A1 * | 9/2020 | Castle | E05B 19/0052 |
| 2020/0362589 | A1 * | 11/2020 | Salter | E05B 17/10 |

* cited by examiner

LOCK SYSTEM WITH MULTIFACTOR AUTHENTICATION

REFERENCE TO RELATED APPLICATION

This application claims the priority benefit of U.S. Provisional Patent Application No. 63/203,551, filed Jul. 27, 2021, which is hereby incorporated by reference in its entirety.

BACKGROUND

Field

The present disclosure relates to security locks and more particularly pertains to a new lock system with multifactor authentication for providing increased security to the lock system.

SUMMARY

In one aspect, the present disclosure relates to a security system with multifactor authentication. The system may comprise a lock assembly which is configured to secure an object, and the lock assembly may have a secured condition and an unsecured condition. The system may also comprise a lock actuating element for actuating the lock assembly between the secured and unsecured conditions. The system may include a first authentication structure configured to permit actuation of the lock assembly by the lock actuating element when authenticated by the first authenticating structure, and a second authentication structure configured to permit actuation of the lock assembly by the lock actuating element when authenticated by the second authentication structure such that authentication by the first authentication structure and the second authentication structure is required for the lock actuating element to actuate the lock assembly.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
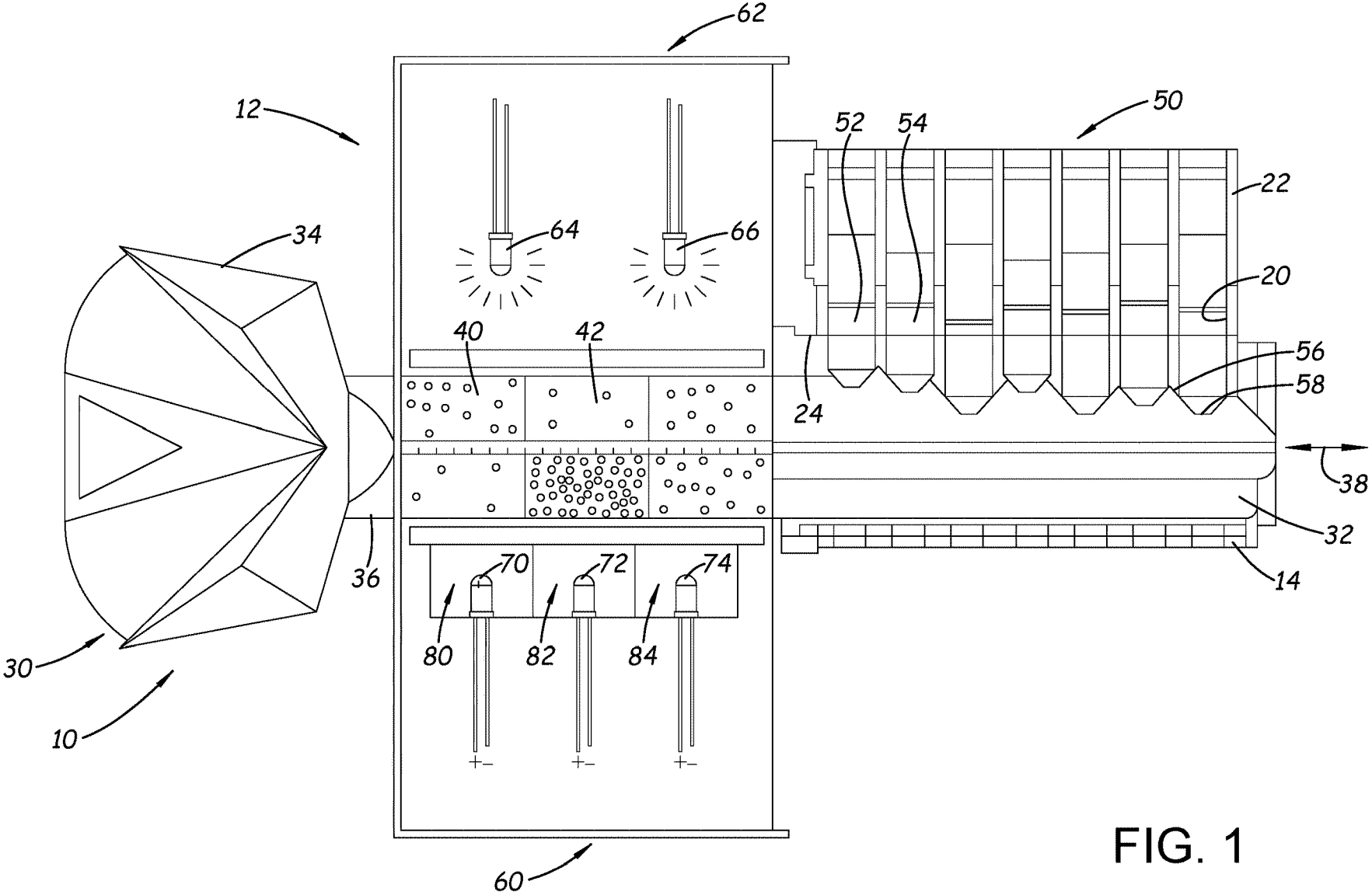
FIG. 1 is a schematic sectional view of elements of a new lock system with multifactor authentication according to the present disclosure.
Figure 2:
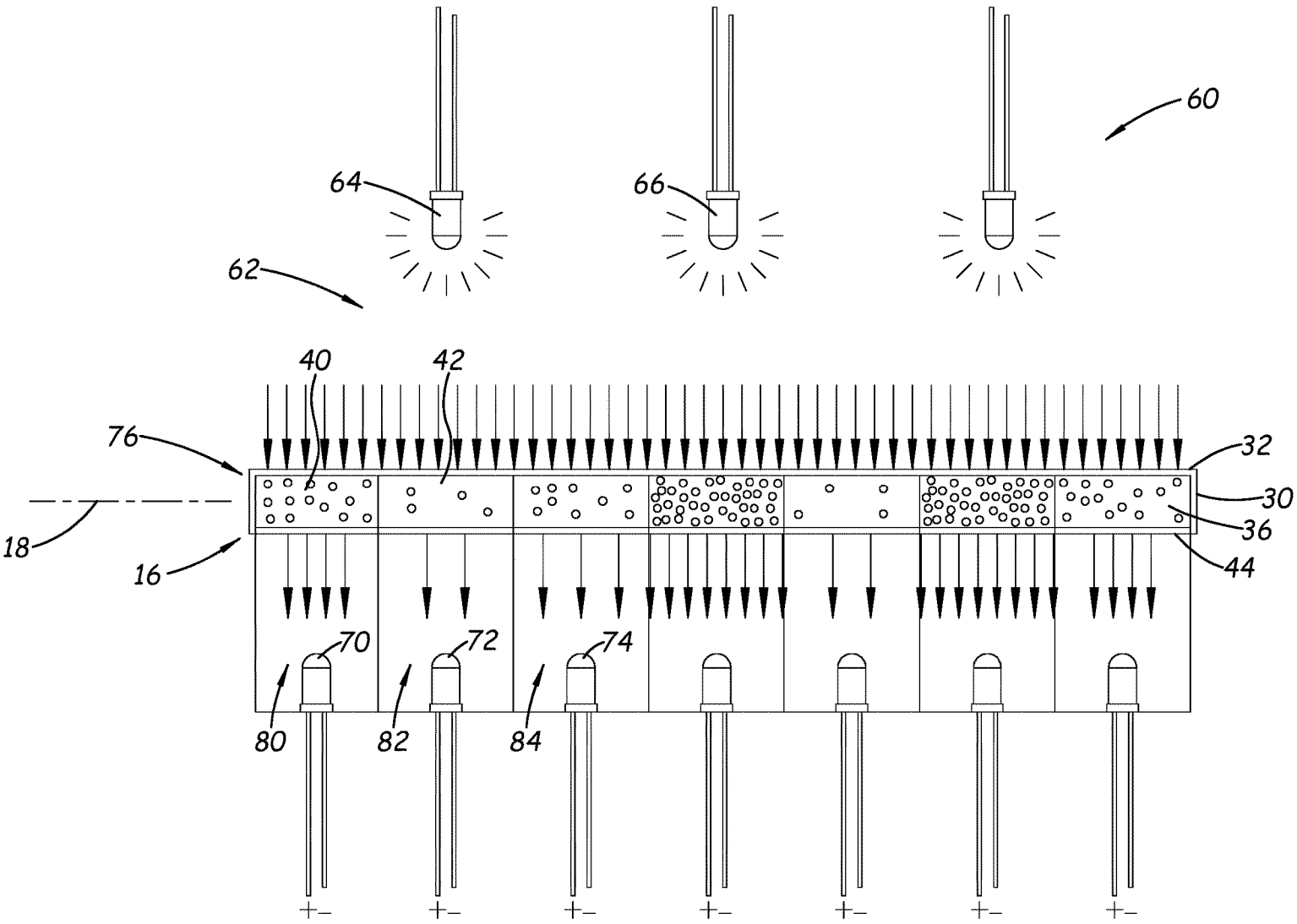
FIG. 2 is a schematic diagrammatic view of elements of the lock system, according to an illustrative embodiment.
Figure 3:
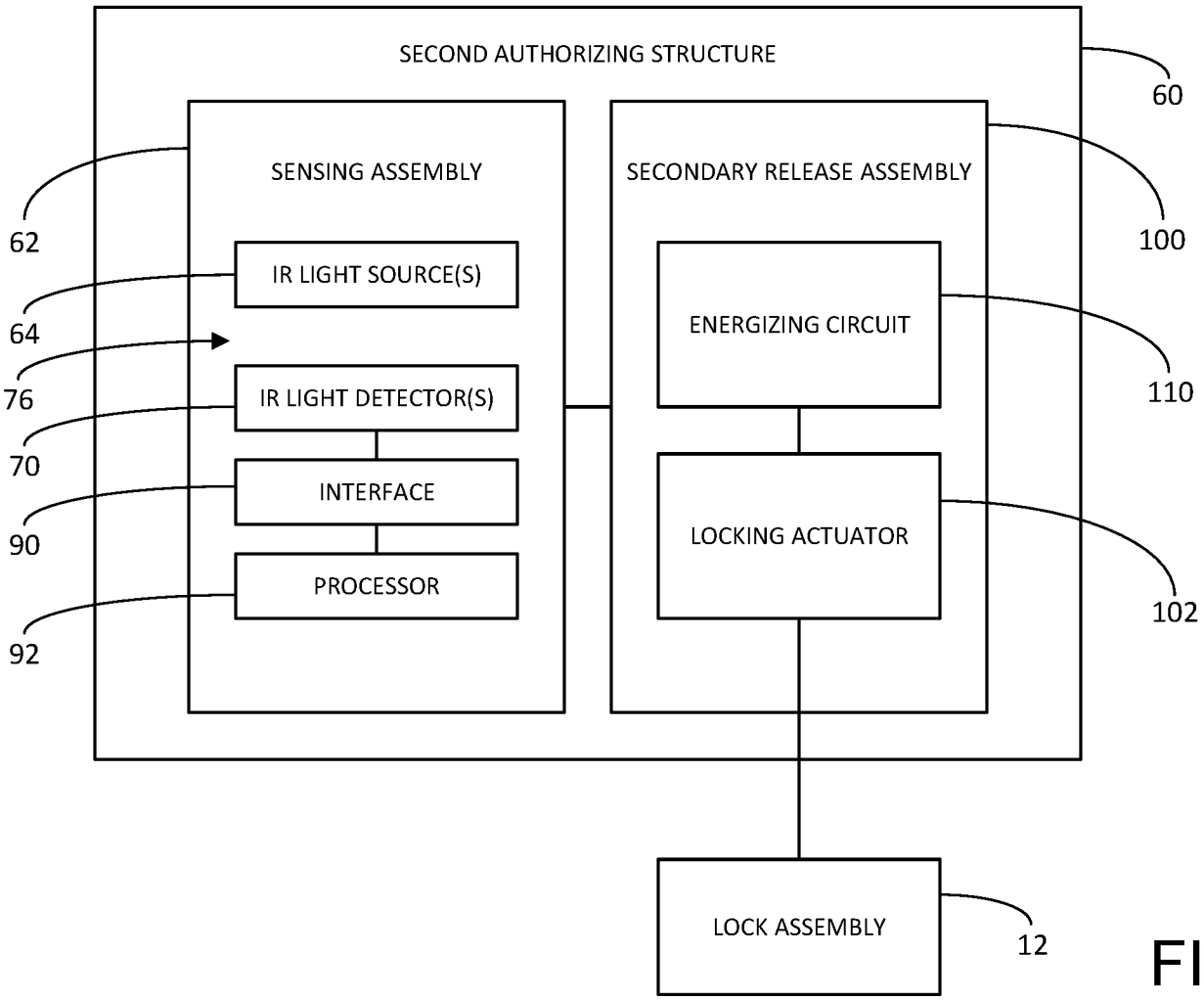
FIG. 3 is a schematic block diagram of elements of the lock system, according to an illustrative embodiment.

With reference now to the drawings, and in particular to FIGS. 1 through 3 thereof, a new lock system with multifactor authentication embodying the principles and concepts of the disclosed subject matter will be described.

Lock systems employing keys to operate the mechanism of the lock assembly inherently employ a scheme for authenticating the key for use with a particular lock, in that the key typically must have the correct bitting in order to operate the pins of the pin tumbler lock. If the bitting of the key moves the pins to the correct positions, the key is "authorized" for the lock and will operate the pin tumbler lock to permit "unlocking" of the lock assembly. Conversely, if the bitting of the key does not move the pins to the correct positions, the key is not "authorized" for the lock and will not operate the pin tumbler lock.

The applicants have also recognized the advantages of an additional level of authentication, or a second factor authentication scheme, which may be integrated into a key (and detected by the lock assembly) which needs to be satisfied in addition to the first factor authentication scheme.

Further, the applicants have recognized that concealment of the specific authenticating characteristics of the key to make it difficult to easily or readily detect or perceive the authenticating characteristics of the key can further frustrate attempts to overcome the authentication schemes, at least in a manner that is simply or quickly executable. For example, while the proper bitting for actuating a lock assembly may not be easily determined by simply viewing the lock, by contrast viewing the bitting cut into a key can provide almost instantaneous recognition of the bitting pattern of an authorized key by someone with little more than passing familiarity with keys. Thus, concealment of the characteristics of the second factor authentication scheme of an authorized key is particularly valuable when the first factor authentication for the key is a conventional form of bitting. Moreover, the applicants have also recognized that making the authenticating characteristics more difficult to create, and thus duplicate, would also be beneficial.

The applicants have devised a security system in which a lock assembly and a lock actuating element (such as a key) employ at least two authentication schemes or structures, with a first authentication structure utilizing bitting on the actuating element to authenticate the actuating element and a second authentication structure utilizing the variability of porosity characteristics of the material forming the lock actuating element to authenticate the actuating element. Moreover, while the bitting of a lock actuating element may be easily perceived and also relatively easily duplicated, the porosity characteristics of the material of the actuating element may be much more difficult to perceive and also may be relatively difficult to duplicate without significant effort.

The disclosure relates to a security system 10 with multifactor authentication, such as may be embodied as a security lock utilized to restrict entry or access to a space via a door or other type of closure selectively providing and preventing access to the space through an opening. In general, the system 10 may include a lock assembly 12 which is utilized to control, for example, access to a space or to free movement of an object, and a lock actuating element 30 utilized to actuate or operate the lock assembly 12. A first authentication structure 50 and a second authentication structure 60 may be provided to restrict operation of the lock assembly 12 by the lock actuating element 32 while generally impeding or preventing operation of the lock assembly 12 by unauthorized actuating elements when authentication by both the first and second authentication structures is not met.

In greater detail, the lock assembly 12 of the security system 10 may have a secured condition and an unsecured condition, and illustratively the secured condition may correspond to the lock assembly blocking or restricting access to a space, such as through a door or other closure, or blocking or restricting the ability to operate or move an associated object. The unsecured condition may correspond to the lock assembly 12 permitting or not restricting access to a space or not restricting the ability to operator move the associated object. The lock assembly 12 may comprise a plug 14 which defines a keyway 16, and the keyway may be elongated along a longitudinal axis 18 extending into the plug. The plug 14 may also define a plurality of channels 20 that are in communication with the keyway and may extend away from the keyway, such as in a substantially perpendicular relationship to the longitudinal axis 18. The lock assembly 12 may further comprise a shell 22 that defines a cavity 24 which receives at least a portion of the plug 14, and the plug may be selectively rotatable in the cavity of the shell, such as about an axis extending substantially parallel to the longitudinal axis 18 of the keyway, to move or operate other elements via, for example, a tailpiece extending from the plug.

The lock actuating element 30 of the system 10 may be provided for actuating the lock assembly 12 between the secured and unsecured conditions, and may be selectively engageable or insertable into the lock assembly when the user is desirous of changing the lock assembly between the secured and unsecured conditions. In general, the lock actuating element 30 has an exterior surface 32 which may be configured with unique characteristics, such as contours, to provide one or more distinctions between authorized and unauthorized elements 30.

The lock actuating element 30 may include a bow portion 34 which is generally configured to be gripped by the fingers of the hand of a user during engagement of the element 30 with the lock assembly 12. The lock actuating element 30 may further include a blade portion 36 which may extend from the bow portion 34 and may be at least partially insertable into the keyway 16 of the lock assembly. The blade portion 36 is typically elongated in a longitudinal direction 38, and the longitudinal direction 38 may be oriented substantially parallel to the longitudinal axis 18 of the keyway 16 of the plug 14 when the blade portion is inserted in the keyway of the lock assembly 12.

In some embodiments, the lock actuating element 30 may include a plurality of subsections 40, 42 of the element. The subsections 40, 42 may be located on one of the portions 34, 36 of the actuating element 30, or may be located on both of the portions 34, 36. In the illustrative embodiments of this disclosure, the subsections 40, 42 will be described as being subsections of the blade portion 36. In general, the lock actuating element 30 is formed from a material, and at least some areas of the material forming the actuating element may have a degree of porosity permitting electromagnetic radiation to at least partially pass through the material with a degree of intensity. Illustratively, the electromagnetic radiation may comprise infrared (IR) radiation, or IR light, although those skilled in the art may recognize other types of radiation or energy suitable for the disclosed functions and purposes upon consideration of this disclosure. In general, a relatively higher degree of porosity of the material corresponds to a relatively higher degree of intensity of the IR light passed through the material and a relatively lower degree of porosity of the material corresponds to a relatively lower degree of intensity of the infrared IR light passed through the material. The porosity of the material of the lock actuating element 30 may vary or be variable between subsections 40, 42 of the element, and the degree of porosity of the material of a first subsection 40 may be different than the degree of porosity of the material of a second subsection 42. Illustratively, the degree of porosity of the material may be substantially uniform within a subsection such that the material of the first subsection 40 has a substantially uniform degree of porosity and the material of the second subsection 42 has a substantially uniform degree of porosity that is different and distinguishable from the first subsection. Although the porosity of the first 40 and second 42 subsections will be considered in this description, additional subsections with similar or different degrees of porosity with respect to the porosity of subsections 40 and 42 may be utilized for the lock actuating element 30.

In embodiments in which the subsections 40, 42 are located on the blade portion 36 of the lock actuating element 30, the subsections are thus located on the portion of the actuating element which is inserted into the keyway 16 of the lock assembly, and the subsections may be arrayed in the longitudinal direction 38 of the blade portion in a linear array, but could also be arrayed in a lateral direction perpendicular to the longitudinal direction instead of, or in addition to, the longitudinal arrangement. Optionally, in some embodiments a protective layer 44 of a substantially IR light transparent material may be applied over the exterior surface 32 of the subsections 40, 42 of the lock actuating element to resist or prevent contaminants from potentially entering the interstices of the porous material of the element 30.

The first authentication structure 50 of the security system 10 may be configured to permit actuation of the lock assembly 12 by the lock actuating element 30 when conditions or requirements imposed by the authentication structure 50 are met or satisfied. A variety of suitable technologies for the first authentication structure 50 are known to those skilled in the art. For the purposes of this description, a conventional pin tumbler lock will be described with the understanding that other lock technologies could be employed. Illustratively, the first authentication structure 50 may comprise a plurality of actuating pins 52, 54 positioned in the channels 20 of the plug 14 of the lock assembly, and may be movable in the channels. The first authentication structure 50 may further comprise bitting 56 on the lock actuating member 30 which may be positioned on the actuating element 30 to contact the actuating pins 52, 54 when the element 30 is inserted into the keyway 16 of the lock assembly 12. The bitting 56 may be configured to move the actuating pins 52, 54 with respect to the plug 14 to adjust the positions of the pins in the channels 20. The bitting 56 may be formed on the blade portion 36 of the actuating element 30 and may include lateral valleys or grooves 58 cut into the blade portion to produce, for example, peaks and valleys in the longitudinal profile of the element 30. When the bitting 56 on the lock actuating element 30 is correct for authentication, the actuating pins 52, 54 are moved in the channels by insertion of the element 30 into the keyway in a manner such that the pins terminate at the sheer line corresponding to the boundary between the plug and the surface of the shell forming the cavity 24 so that the pins do not resist rotation of the plug within the shell. Conversely, when the bitting on the lock actuating element 30 is not correct for authentication, the actuating pins 52, 54 are not moved in the channels to terminate at the sheer line when the element 30 is inserted into the keyway, and at least some (if not all) of the pins will extend across the sheer line to resist or block rotation of the plug with respect to the shell. Optionally, the first authenticating structure may utilize elements of the LOCK SYSTEM WITH ENHANCED KEYWAY VARIABILITY disclosed in U.S. patent application Ser. No. 16/705,789, filed Dec. 6, 2019, which is hereby incorporated by reference in its entirety. As another option, the first authenticating structure may utilize disk detainer technology, such as is available from, for example, Abloy of Finland.

The second authentication structure 60 of the system 10 may be configured to permit actuation of the lock assembly by the lock actuating element when conditions or requirements imposed by the authentication structure 60 are met or satisfied. The second authentication structure 60 may comprise a sensing assembly 62 configured to sense variations in the porosity of the material forming the lock actuating element 30, or at least in the material of the subsections 40, 42 of the element 30. The sensing assembly 62 may include at least one IR light source 64 which may be mounted on the lock assembly 12, and may be mounted on the plug 14 of the assembly 12. In some embodiments, the IR light source 64 may be positioned along at least a portion of the keyway 16 of the plug to emit IR light into the keyway and onto a portion of the lock actuating element 30, such as portion or portions of the element 30 having the subsections 40, 42 of the element 30. Illustratively, the IR light source 64 may be configured to emit IR light onto the blade portion 36 of a lock actuating element 30 when the element 30 is inserted into the keyway. In some embodiments, a plurality of the IR light sources 64, 66 may be utilized, and the IR light sources may be arranged in an array alongside the keyway 16 of the plug.

The sensing assembly 62 may further include a plurality of IR light detectors 70, 72, 74 which are configured to detect IR light emitted from the IR light source. The plurality of IR light detectors 70, 72, 74 may be positioned along at least a portion of the keyway 16 of the plug 14, and may be positioned in opposition to the one or more IR light sources 64, 66. A gap 76 may be defined between the plurality of IR light detectors 70, 72, 74 and the IR light source or sources 64, 66, and the gap 76 may correspond to at least a portion of the keyway 16 of the plug such that the blade portion 36 of a lock actuating element 30 inserted into the keyway moves into the gap 76 between the sources 64, 66 and the detectors 70, 72, 74.

The IR light detectors 70, 72, 74 may be positioned in a plurality of subzones adjacent to the keyway 16, and each IR light detector 70, 72, 74 may be positioned in a separate respective subzone 80, 82, 84 of the plurality of subzones along the keyway. Each of the subzones 80, 82, 84 may correspond to one of the subsections 40, 42 of the blade portion 36. The plurality of subzones 80, 82, 84 may be arrayed along the longitudinal axis 18 of the keyway, and the subzones being arrayed in a series along the keyway, although other arrangements and configurations may be utilized which suitably correspond to the arrangements and configurations of the subsections of the actuating element 30.

The IR light detectors 70, 72, 74 may be configured to detect the magnitude of IR light emitted by the one or more one IR light sources which passes through the material of the lock actuating element 30 to reach the IR light detector. Each of the IR light detectors 70, 72, 74 may detect the magnitude of the intensity of the IR light originating from one of the light sources and passing through a subsection 40, 42 of the actuating element 30 and reaching a light detector corresponding to the subzone aligned with the subsection of the element 30. Each of the IR light detectors 70, 72, 74 may generate a signal that corresponds to the magnitude of IR light detected by the IR light detector which has passed through the corresponding subsection of the material of the blade portion and reached the light detector. The signal output by an IR light detector may be in the form of an output voltage of the IR light detector, although suitable light detectors may also provide the output signal in other forms.

The second authentication structure 60 may also include an interface 90 configured to receive the signals of the plurality of IR light detectors 70, 72, 74, and may convert each of the signals detectors into discrete values that correspond to the magnitude of the IR light represented by the signal. In some embodiments, the interface 90 may be configured to determine a level of the output voltage of the signal and generate a digital value that corresponds to the magnitude of the voltage level of the signal. The second authentication structure 60 may further include a processor 92 which is in communication with the plurality of IR light detectors 70, 72, 74, such as via the interface 90. The processor 92 may receive from the interface 90 the digital values of the signals from the individual IR light detectors 70, 72, 74, and the processor may be configured to compare the digital values representative of the IR light passing through the lock actuating element 30 to digital values of a predetermined or previously stored series of values for the respective subzones 80, 82, 84. The stored series of values for the subzones may correspond to the values expected or required of an authorized lock actuating element 30 when engaging the lock assembly 12.

The second authentication structure 60 may include a secondary release assembly 100 configured to block or permit rotation of the plug 14 in the cavity 24 of the shell based upon sensing of an authorized lock actuating element 30 by the sensing assembly 62. In some embodiments, the secondary release assembly 100 may include a locking actuator 102 which may be mounted on the lock assembly 12, such as, for example, on the shell 22. The locking actuator 102 may have a locked condition and a release condition. The locked condition of the actuator 102 may be characterized by the locking actuator engaging the plug 14 to resist or prevent rotation of the plug with respect to the shell 22. The release condition of the locking actuator 102 may be characterized by the actuator 102 being disengaged from the plug to permit rotation of the plug with respect to the shell. In some embodiments, the locking actuator 102 may comprise a solenoid including a coil configured to be selectively energized and a plunger configured to be moved by the coil when the coil is energized. Illustratively, in the locked condition of the locking actuator 102, the plunger may be moved to engage the plug and resist the rotation of the plug, while in the release condition the plunger may be moved to disengage from the plug to permit rotation of the plug with respect to the shell. The secondary release assembly 100 may further include an energizing circuit 110 configured to selectively energize the solenoid responsive to a signal from the sensing assembly, such as the processor 92. The energizing circuit 110 may be in communication with a power supply to provide the electrical energy for the energizing circuit.

In some highly preferred implementations of the disclosure, the lock actuating element 30 may be formed using an additive manufacturing technology, such as, for example, so-called "3-D" printing technology, which provides not only an enhanced ability to provide the actuating element 30 with relatively fine or small contours (e.g., for forming bitting on the element 30), but also facilitates formation of the actuating element 30 with portions and subsections in which the material has various degrees of porosity, which is advantageous in that such an approach can provide a larger variety of values coded into the material as compared to, for example, simply detecting the presence of material or the absence of material (a binary code). Illustratively, 3-D printing technologies such as selective laser melting (SLM) may provide the degree of control of the density or porosity of the material at different locations on the lock actuating element 30. Advantageously, the variation in the porosity of the material of the actuating element 30 may be accomplished with little or no additional cost involved as the variation in porosity may be created as a part of the formation process for the element 30. Further, densities or porosities of the material of the subsections may be varied from subsection to subsection without producing a visually perceptible variation between subsections that might reveal the authenticating structure. Further, the variation in porosity may be produced without a physically—or mechanically—perceptible variation between the subsections which would be capable of physically or mechanically actuating elements of, for example, a lock assembly.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A security system with multifactor authentication, the system comprising:

a lock assembly configured to secure an object, the lock assembly having a secured condition and an unsecured condition, the lock assembly including a plug defining a keyway elongated along a longitudinal axis extending into the plug;

a lock actuating element for actuating the lock assembly between the secured and unsecured conditions, the lock actuating element including a blade portion being at least partially insertable into the keyway of the lock assembly;

a first authentication structure of the lock actuating element having a first authentication characteristic configured to actuate the lock assembly when the lock actuating element is engaged with the lock assembly, the first authentication structure comprising a shape of the lock actuating element; and a second authentication structure of the lock actuating element having a second authentication characteristic configured to actuate the lock assembly when the lock actuating element is engaged with the lock assembly, the second authentication structure comprising a porosity of the lock actuating element;

wherein authentication by the first authentication structure and the second authentication structure is required for the lock actuating element to actuate the lock assembly;

wherein the lock actuating element is formed from a material, at least some areas of the material of the lock actuating element having a substantially uniform degree of porosity permitting electromagnetic radiation to at least partially pass through the areas of the material with a degree of intensity; and wherein the electromagnetic radiation comprises infrared (IR) light.

2. The system of claim 1 wherein the lock assembly comprises a shell defining a cavity receiving the plug, the plug being selectively rotatable in the cavity of the shell, the plug being rotatable about an axis substantially parallel to the longitudinal axis of the keyway.

3. The system of claim 1 wherein the lock actuating element includes a bow portion configured to be gripped by the hand of a user, the blade portion extending from the bow portion.

4. The system of claim 1 wherein the lock actuating element includes a plurality of subsections of the element, the degree of porosity of the material of the lock actuating element being variable between the subsections.

5. The system of claim 4 wherein a degree of porosity of the material of a first said subsection of the lock actuating element being different than a degree of porosity of the material of a second said subsection of the lock actuating element.

6. The system of claim 4 wherein the subsections of the lock actuating element are located on the blade portion of the lock actuating element insertable into the keyway of the plug of the lock assembly.

7. The system of claim 6 wherein the subsections of the lock actuating element are arrayed in a longitudinal direction of the blade portion.

8. The system of claim 6 wherein the subsections of the lock actuating element are arrayed in a lateral direction of the blade which is oriented substantially perpendicular to a longitudinal direction of the blade portion.

9. The system of claim 1 wherein the lock actuating element includes a protective layer of a material substantially transparent to the electromagnetic radiation applied over an exterior surface of the material of the actuating element.

10. The system of claim 1 wherein the plug defines a plurality of channels in communication with the keyway, and the first authentication structure comprises:

bitting formed on the lock actuating member; and a plurality of actuating pins positioned in the channels formed in the plug to contact the actuating pins when the lock actuating element is at least partially inserted into the keyway of the plug;

wherein the bitting is configured to move the actuating pins with respect to the plug.

11. The system of claim 1 wherein the second authentication structure comprises a sensing assembly configured to sense variations in the degree of porosity of the material forming the lock actuating element.

12. The system of claim 11 wherein the sensing assembly comprises:

at least one electromagnetic radiation source on the lock assembly in a position to emit the radiation into the keyway and onto a blade portion of a said lock actuating element inserted into the keyway; and at least one electromagnetic radiation detector on the lock assembly in a position relative to the keyway to detect a magnitude of the electromagnetic radiation emitted by the at least one radiation source which passes through the material of the lock actuating element to reach the radiation detector.

13. The system of claim 12 wherein the lock actuating element includes a plurality of subsections of the element, the degree of porosity of the material of the lock actuating element being variable between the subsections; and wherein the sensing assembly comprises a plurality of the electromagnetic radiation detectors being positioned along the keyway of the plug, each of the radiation detectors being positioned in a subzone of a plurality of subzones, each of the subzones having a position corresponding to a position of a said subsection of the plurality of subsections of the lock actuating element when the lock actuating element is inserted into the keyway.

14. The system of claim 12 wherein the at least one electromagnetic radiation detector is configured to generate a signal corresponding to the magnitude of the electromagnetic radiation detected passing through the material of the blade portion and reaching the electromagnetic radiation detector.

15. The system of claim 11 wherein the sensing assembly further comprises:

an interface configured to receive the signal of the at least one electromagnetic radiation detector and convert the signal into a value corresponding to the magnitude of the electromagnetic radiation represented by the signal; and a processor in communication with the at least one electromagnetic radiation detector via the interface, the processor being configured to receive from the interface the value of the signal from the radiation detector and compare the value representative of the radiation detected and a value of a stored value corresponding to an authorized lock actuating element.

16. The system of claim 15 wherein the second authenticating structure includes a secondary release assembly configured to block or permit rotation of the plug based upon sensing a match between the value representative of the radiation detected and the value of the stored value corresponding to the authorized lock actuating element.

17. A security system with multifactor authentication, the system comprising:

a lock assembly configured to secure an object, the lock assembly having a secured condition and an unsecured condition, the lock assembly including a plug defining a keyway elongated along a longitudinal axis extending into the plug;

a lock actuating element for actuating the lock assembly between the secured and unsecured conditions, the lock actuating element including an elongated blade portion being at least partially insertable into the keyway of the lock assembly;

a first authentication structure of the lock actuating element having a first authentication characteristic configured to actuate the lock assembly when the lock actuating element is engaged with the lock assembly, the first authentication structure comprising a shape of the lock actuating element; and a second authentication structure of the lock actuating element having a second authentication characteristic configured to actuate the lock assembly when the lock actuating element is engaged with the lock assembly, the second authentication structure comprising a porosity of the lock actuating element;

wherein authentication by the first authentication structure and the second authentication structure is required for the lock actuating element to actuate the lock assembly;

wherein the lock actuating element is formed from a material, at least some areas of the material of the lock actuating element having a degree of porosity permitting electromagnetic radiation to at least partially pass through the areas of the material with a degree of intensity;

wherein the lock actuating element includes a plurality of subsections of the element arrayed on the blade portion along a longitudinal axis of the elongated blade portion;

wherein the degree of porosity of the material of the lock actuating element is substantially uniform within each subsection of the lock actuating element; and wherein the degree of porosity of the material of the lock actuating element is variable between the subsections such that a degree of porosity of the material of a first said subsection of the lock actuating element being different than a degree of porosity of the material of a second said subsection of the lock actuating element.

18. The system of claim 16 wherein the electromagnetic radiation comprises infrared (IR) light.

* * * * *